US010991318B2

(12) United States Patent
Orio et al.

(10) Patent No.: US 10,991,318 B2
(45) Date of Patent: Apr. 27, 2021

(54) DEVICE AND METHOD FOR COMPENSATION OF POWER SOURCE VOLTAGE DROP IN DISPLAY PANEL

(71) Applicant: SYNAPTICS INCORPORATED, San Jose, CA (US)

(72) Inventors: Masao Orio, Tokyo (JP); Hirobumi Furihata, Tokyo (JP); Takashi Nose, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/580,998

(22) Filed: Sep. 24, 2019

(65) Prior Publication Data

US 2020/0111423 A1 Apr. 9, 2020

(30) Foreign Application Priority Data

Oct. 4, 2018 (JP) ..... 2018-189497

(51) Int. Cl.
*G09G 3/3291* (2016.01)

(52) U.S. Cl.
CPC ... *G09G 3/3291* (2013.01); *G09G 2320/0233* (2013.01); *G09G 2330/028* (2013.01)

(58) Field of Classification Search
CPC ... G09G 2300/0426; G09G 2320/0223; G09G 2320/0233; G09G 2330/02; G09G 2330/028; G09G 3/3225; G09G 3/3291
See application file for complete search history.

(56) References Cited

U.S. PATENT DOCUMENTS

2003/0063110 A1* 4/2003 Sagano ..... G09G 3/22 345/694
2003/0122759 A1* 7/2003 Abe ..... G09G 3/22 345/89
2004/0165004 A1* 8/2004 Sagano ..... G09G 3/22 345/691
2009/0207106 A1* 8/2009 Mizukoshi ..... G09G 3/3233 345/76
2010/0020065 A1* 1/2010 Takasugi ..... G09G 3/3233 345/214
2020/0143750 A1* 5/2020 Gao ..... G09G 3/3291

* cited by examiner

*Primary Examiner* — Chun-nan Lin
(74) *Attorney, Agent, or Firm* — Ferguson Braswell Fraser Kubasta PC

(57) ABSTRACT

A display driver comprises image processing circuitry, compensation circuitry, voltage data generator circuitry, and drive circuitry. The image processing circuitry is configured to generate a first voltage data based on an image data corresponding to an image to be displayed on a display panel. The compensation circuitry is configured to generate correction values for pixels of the display panel, based on a total current consumed in the pixels of the display panel and positions of the pixels in the display panel. The voltage data generator circuitry is configured to generate a second voltage data by correcting the first voltage data based on the correction values. The drive circuitry is configured to write drive voltages into the pixels based on the second voltage data.

20 Claims, 10 Drawing Sheets

DEVICE AND METHOD FOR COMPENSATION OF POWER SOURCE VOLTAGE DROP IN DISPLAY PANEL

CROSS REFERENCE

This application claims priority to Japanese Patent Application No. 2018-189497, filed on Oct. 4, 2018, the disclosure of which is incorporated herein by reference in its entirety.

BACKGROUND

Field

Embodiments disclosed herein generally relate to a device and method for compensation of power source voltage drop in a display panel.

Description of the Related Art

Some sorts of display panels, such as organic light emitting diode (OLED) display panels, are configured to supply a power source voltage to respective pixel circuits via power source lines. A display panel thus configured may exhibit mura in a displayed image due to voltage drop, for example, across power source lines in the display panel.

SUMMARY

In one or more embodiments, a display driver comprises image processing circuitry, compensation circuitry, voltage data generator circuitry, and drive circuitry. The image processing circuitry is configured to generate a first voltage data based on an image data corresponding to an image to be displayed on a display panel. The compensation circuitry is configured to generate correction values for a plurality of pixels of the display panel, based on a total current consumed in the plurality of pixels and positions of the plurality of pixels. The voltage data generator circuitry is configured to generate a second voltage data by correcting the first voltage data based on the correction values. The drive circuitry is configured to write drive voltages into the plurality of pixels based on the second voltage data.

In one or more embodiments, a display device comprises a display panel, image processing circuitry, compensation circuitry, voltage data generator circuitry, and drive circuitry. The display panel comprises a plurality of power source terminals and a plurality of pixels configured to receive a power source voltage from the plurality of power source terminals. The image processing circuitry is configured to generate a first voltage data based on an image data corresponding to an image to be displayed on the display panel. The compensation circuitry is configured to generate correction values for a plurality of pixels based on a total current consumed in the plurality of pixels and positions of the plurality of pixels. The voltage data generator circuitry is configured to generate a second voltage data by correcting the first voltage data based on the correction values; and drive circuitry configured to write drive voltages into the plurality of pixels based on the second voltage data.

In one or more embodiments, a method for driving a display comprises generating a first voltage data based on an image data corresponding to an image to be displayed on a display panel comprising a plurality of power source terminals and a plurality of pixels configured to receive a power source voltage from the plurality of power source terminals, generating correction values for the plurality of pixels, based on a total current consumed in the plurality of pixels and positions of the plurality of pixels, generating a second voltage data by correcting the first voltage data based on the correction values, and writing drive voltages into the plurality of pixels based on the second voltage data.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1:
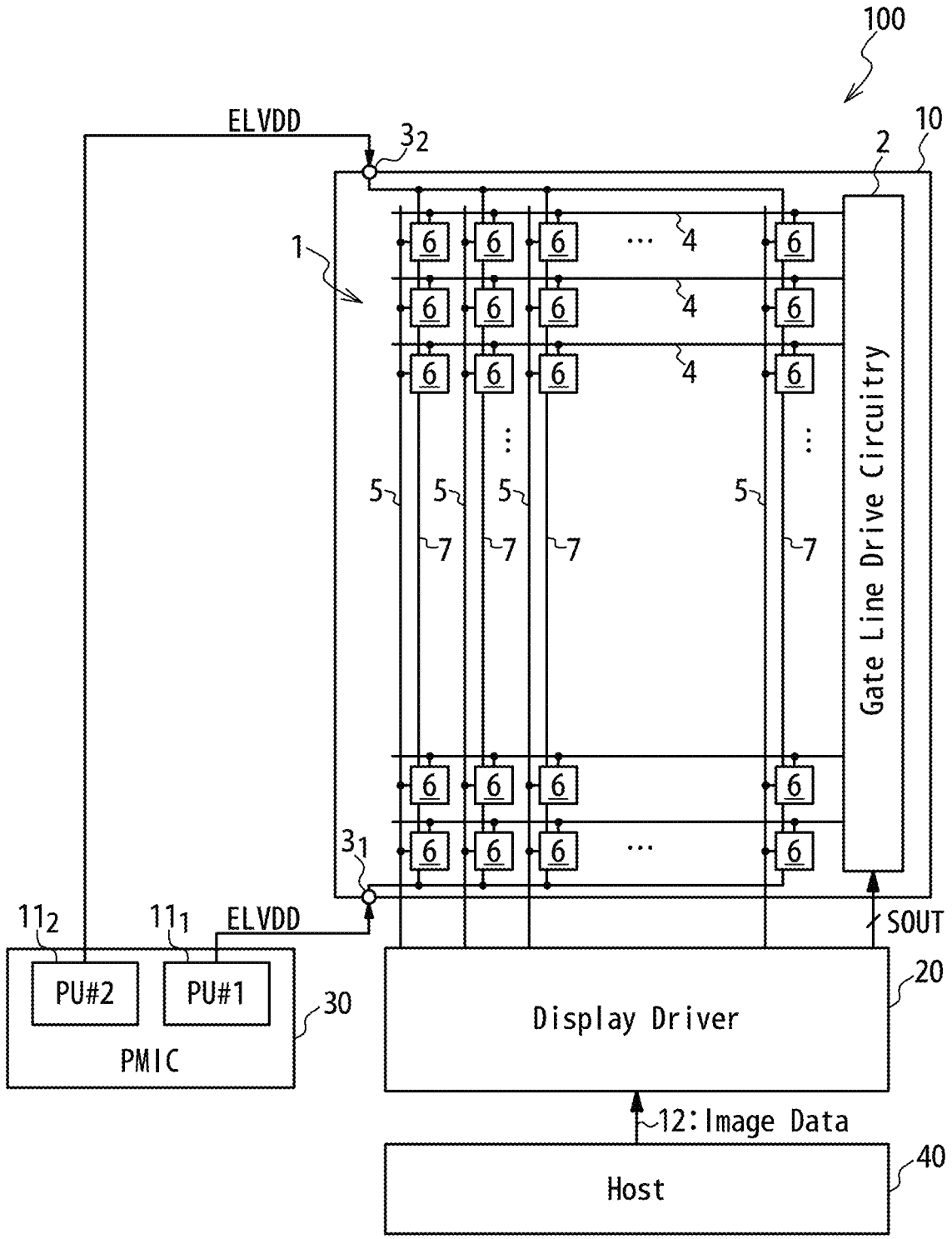
FIG. 1 illustrates one example configuration of a display device, according to one or more embodiments.

A description is given below of various embodiments with reference to the attached drawings. In the following, identical or similar elements may be denoted by same or corresponding reference numerals. Suffixes may be attached to reference numerals to distinguish identical elements from each other.

In one or more embodiments, as illustrated in FIG. 1, a display device 100 comprises a display panel 10 and a display driver 20. The display panel 10 may be an organic light emitting diode (OLED) display panel, for example.

In one or more embodiments, a display panel 10 comprises a pixel array 1 and gate line drive circuitry 2. In one or more embodiments, the pixel array 1 comprises gate lines 4, source lines 5, pixel circuits 6, and power source lines 7. In one or more embodiments, each pixel circuit 6 is connected to a corresponding gate line 4 and source line 5. In one or more embodiments, the gate line drive circuitry 2 is configured to drive the gate lines 4 based on gate control signals SOUT received from the display driver 20.

In various embodiments, the display panel 10 comprises a plurality of power source terminals, two power source terminals $3_1$ and $3_2$ as illustrated in FIG. 1. In one or more embodiments, one end of each power source line 7 is connected to the power source terminal $3_1$ and the other end is connected to the power source terminal $3_2$. In one or more embodiments, a power source voltage ELVDD is supplied to each of the power source terminals $3_1$ and $3_2$ from a power management integrated circuit (PMIC) 30. In one or more embodiments, power sources $11_1$ and $11_2$ are integrated in PMIC 30. The power sources $11_1$ and $11_2$ may be disposed separately from the PMIC 30. In one or more embodiments, the power sources $11_1$ and $11_2$ are configured to supply the power source voltage ELVDD to the power source terminals $3_1$ and $3_2$, respectively. In one or more embodiments, the power sources $11_1$ and $11_2$ are controlled to output the power source voltage ELVDD with the same voltage level.

In one or more embodiments, each pixel circuit 6 is configured to receive the power source voltage ELVDD via a power source line 7 and operate on the received power source voltage ELVDD. In one or more embodiments, each pixel circuit 6 comprises an OLED element. In one or more embodiments, the OLED element is configured to emit light when a drive current flows from a power source terminal supplied with the power source voltage ELVDD to circuit ground through the OLED element.

In one or more embodiments, the voltage levels of the power source voltage ELVDD actually supplied to the respective pixel circuits 6 may be dependent on the pixel circuits 6, due to voltage drop across the power source lines 7, even when the power sources $11_1$ and $11_2$ are designed to generate the power source voltage ELVDD with the same voltage level. Variations in the voltage level of the power source voltage ELVDD actually supplied to the pixel circuits 6 may cause mura in an image displayed on the display panel 10.

Figure 2:
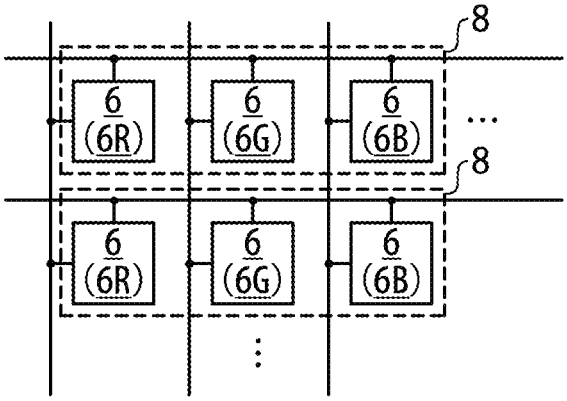
FIG. 2 illustrates one example configuration of pixels, according to one or more embodiments.

In one or more embodiments, as illustrated in FIG. 2, each pixel 8 of the display panel 10 comprises pixel circuits 6 configured to display red (R), green (G), and blue (B), respectively. In one or more embodiments, the pixel circuits 6 configured to display red (R), green (G), and blue (B) are used as a R subpixel, G subpixel, and B subpixel, respectively, which may be hereinafter referred to as R subpixel 6R, G subpixel 6G, and B subpixel 6B, respectively. In one or more embodiments, the R subpixel 6R, G subpixel 6G, and B subpixel 6B of each pixel 8 are connected to the same gate line 4. Each pixel 8 may comprise one or more additional subpixels configured to display one or more colors other than red, green, and blue. Note that the combination of colors is not limited to that disclosed herein. In one or more embodiments, the display panel 10 may be adapted to subpixel rendering (SPR). In such embodiments, each pixel 8 may comprise multiple R subpixels 6R, multiple G subpixels 6G, and/or multiple B subpixels 6B.

In one or more embodiments, the display driver 20 is configured to receive an image data 12 from a host 40 and drive the display panel 10 so that an image corresponding to the image data 12 is displayed on the display panel 10. In one or more embodiments, the display driver 20 is configured as an integrated circuit (IC).

Figure 3:
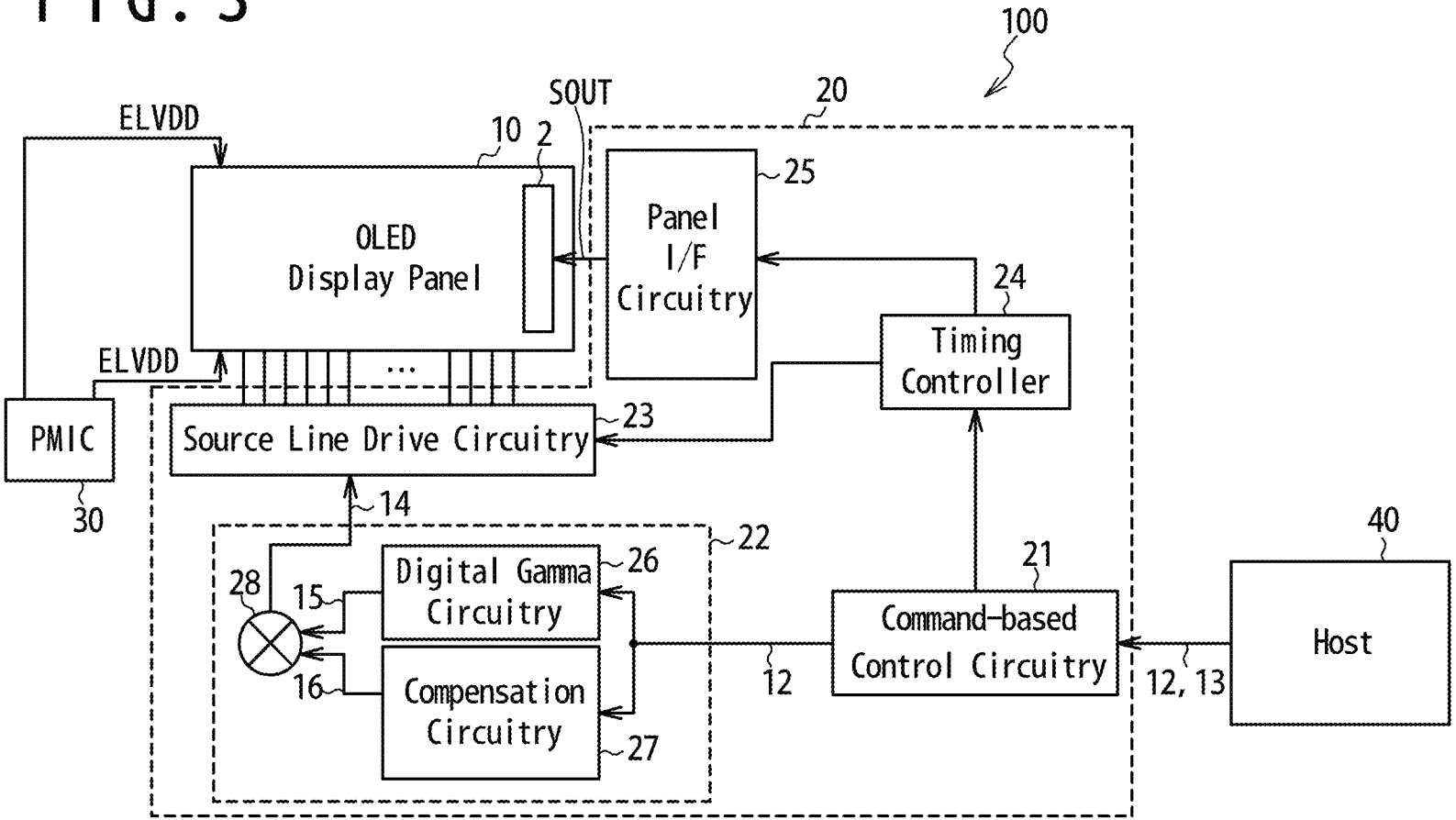
FIG. 3 illustrates one example configuration of a display driver, according to one or more embodiments.

In one or more embodiments, as illustrated in FIG. 3, the display driver 20 comprises command-based control circuitry 21, image processing circuitry 22, source line drive circuitry 23, a timing controller 24, and panel interface circuitry 25.

In one or more embodiments, the command-based control circuitry 21 is configured to forward the image data 12 received from the host 40 to the image processing circuitry 22. In one or more embodiments, the command-based control circuitry 21 is configured to operate as an interface. In one or more embodiments, the command-based control circuitry 21 is further configured to control the timing controller 24 based on a control data 13 received from the host 40.

In one or more embodiments, image processing circuitry 22 is configured to perform digital image processing on the received image data 12 to generate a voltage data 14. In one or more embodiments, the voltage data 14 thus generated describes voltage levels of drive voltages to be written into the respective pixel circuits 6 of the respective pixels 8.

In one or more embodiments, the source line drive circuitry 23 is configured to drive the source lines 5 based on the voltage data 14 received from the image processing circuitry 22 to write drive voltages of desired voltage levels into the respective pixel circuits 6 of the display panel 10.

In one or more embodiments, timing controller 24 is configured to perform timing control of respective circuitry in the display driver 20.

In one or more embodiments, the panel interface circuitry 25 is configured to generate the gate control signals SOUT under the control of the timing controller 24 and supply the gate control signals SOUT to the gate line drive circuitry 2 of the display panel 10.

In one or more embodiments, as illustrated in FIG. 3, the image processing circuitry 22 comprises digital gamma circuitry 26, compensation circuitry 27, and output voltage data generator circuitry 28.

In one or more embodiments, the digital gamma circuitry 26 is configured to generate a voltage data 15 based on the image data 12 so that the voltage data 15 specify voltage levels of the drive voltages to be written into the respective pixel circuits 6 of the respective pixels 8 to display an image with a specified gamma property.

In one or more embodiments, the voltage data 14 supplied to the source line drive circuitry 23 is generated by correcting the voltage data 15 generated by the digital gamma circuitry 26 so that voltage drop across the power source lines 7 is compensated. In one or more embodiments, the voltage data 14 thus generated is used to drive the pixel circuits 6. To clarify that the voltage data 14 supplied to the source line drive circuitry 23 is generated so as to compensate the voltage drop, the voltage data 14 may be hereinafter referred to as compensated voltage data 14. In one or more embodiments, driving the display panel 10 based on the compensated voltage data 14 effectively reduces or suppresses generation of mura in the displayed image.

In one or more embodiments, the compensation circuitry 27 is configured to generate correction values used for correction of the voltage data 15. In one or more embodiments, the correction values comprise compensation gains 16.

In one or more embodiments, the output voltage data generator circuitry 28 is configured to generate the compensated voltage data 14 by correcting the voltage data 15 generated by the digital gamma circuitry 26 based on the correction values generated by the compensation circuitry 27. In one or more embodiments, the output voltage data generator circuitry 28 is configured to generate the compensated voltage data 14 to be supplied to the source line drive circuitry 23 by multiplying the voltage data 15 by the compensation gains 16. In one or more embodiments, voltage values described in the compensated voltage data 14 to specify the drive voltages to be supplied to the respective pixel circuits 6 of the respective pixels 8 are calculated as being products obtained by multiplying the voltage values described in the voltage data 15 for the respective pixel circuits 6 of the respective pixels 8 by the values of the compensation gains 16 generated for the respective pixels 8.

In one or more embodiments, the display driver 20 or the image processing circuitry 22 may comprise an image processing module or circuitry configured to perform different digital image processing. In one or more embodiments, an image data generated by performing the different digital image processing on the image data 12 may be supplied to the digital gamma circuitry 26 and the compensation circuitry 27 in place of the image data 12.

In one or more embodiments, generation of mura in the displayed image is effectively suppressed by using the correction values, e.g., the compensation gains 16 in one or more embodiments, to compensate the voltage drop across the power source lines 7 of the display panel 10.

Figure 4:
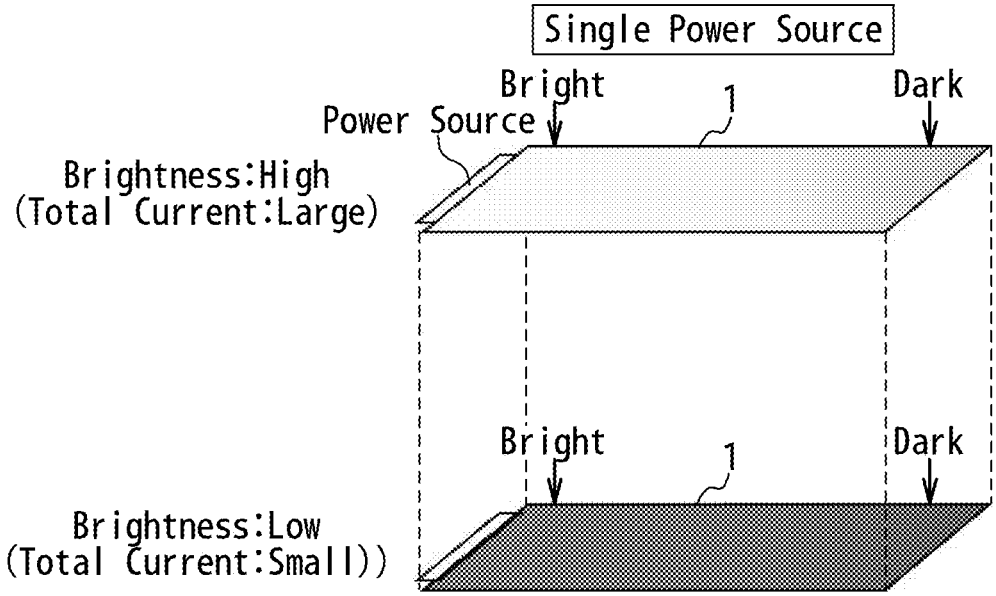
FIG. 4 illustrates one example dark-bright pattern for a case when a power source voltage is supplied to a display panel from a single power source, according to one or more embodiments.

As illustrated in FIG. 4, when the power source voltage ELVDD is supplied from a single power source to the display panel 10, a substantially-fixed dark-bright pattern may appear on the display panel 10 regardless of the brightness level of the image displayed on the display panel 10. For example, a region of the display panel 10 close to the power source may become bright, and a region far from the power source becomes dark.

Figure 5:
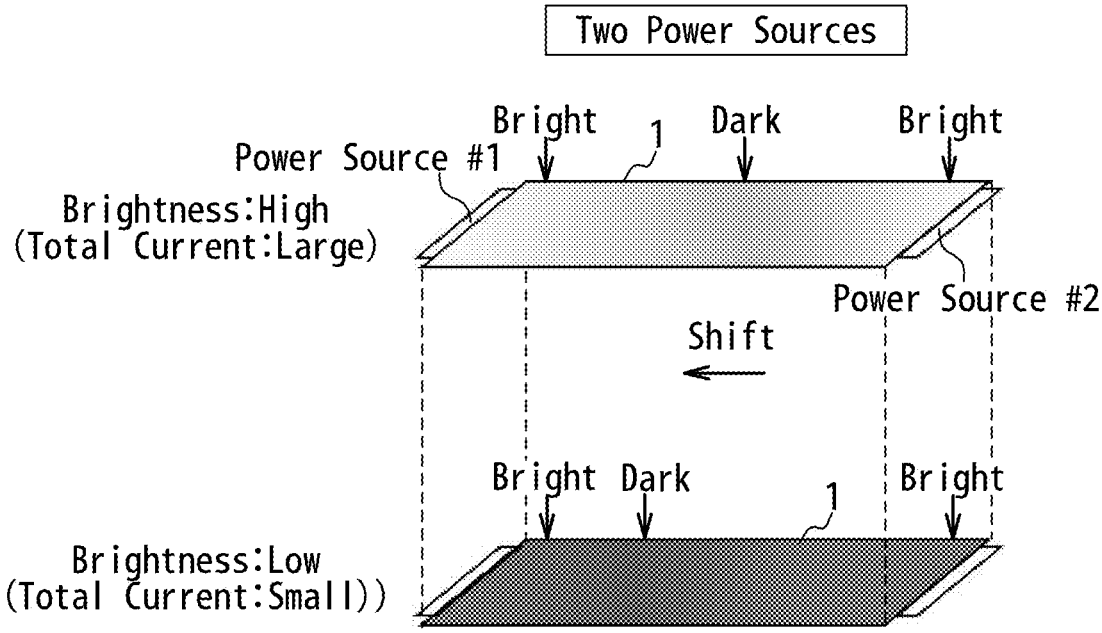
FIG. 5 illustrates one example dark-bright pattern for a case when a power source voltage is supplied to a display panel from two power sources, according to one or more embodiments.

When the power source voltage ELVDD is supplied from two or more power sources to the display panel 10 as illustrated in FIG. 5, on the other hand, the dark-bright pattern may vary depending on the brightness level of the image displayed on the display panel 10. This phenomenon may result from a difference between or among characteristics of the power sources. In one or more embodiments, the brightness of the image displayed on the display panel 10 depends on the total current consumed in the pixels 8 of the display panel 10. In one or more embodiments, the "total current" is the sum of the currents consumed in the respective pixel circuits 6 of the respective pixels 8 of the display panel 10 for the entirety of the display panel 10. The total current consumed in the pixels 8 of the display panel 10 increases as the image displayed on the display panel 10 becomes brighter. When the total current varies, the dark-bright pattern may vary depending on the level of the total current when the power sources exhibit different behaviors due to the difference in the characteristics of the power sources.

In various embodiments, the compensation circuitry 27 is configured to generate the correction values used for correcting the voltage data 15. Further, the compensation gains 16 are used for generating the compensated voltage data 14 so that the voltage drop across the power source lines 7 is appropriately compensated when the power source voltage ELVDD is supplied to the display panel 10 from a plurality of power sources. For example, as illustrated in FIG. 1, the power source voltage ELVDD is supplied by the power sources $\mathbf{11}_1$ and $\mathbf{11}_2$. In such an example, the compensation gains 16 may be used to generate compensated voltage data to compensate for any voltage drop between the power source lines 7 coupled to the power sources $\mathbf{11}_1$ and $\mathbf{11}_2$.

In one or more embodiments, the compensation circuitry 27 is configured to generate a correction value for each pixel 8, based on the total current consumed in the pixels 8 of the display panel 10 and the position of each pixel 8. The compensation circuitry 27 may be configured to calculate a simulated value of the total current consumed in the pixels 8 of the display panel 10 and generate the correction value for each pixel 8 based on the calculated simulated value and the position of each pixel 8. The output voltage data generator circuitry 28 is configured to generate the compensated voltage data 14 by correcting the voltage data 15 received from the digital gamma circuitry 26, based on the generated correction value. Further, the compensated voltage data 14 thus generated may be supplied to the source line drive circuitry 23. The compensated voltage data 14 may be utilized for compensation of the voltage drop across the power source lines 7.

Figure 6:
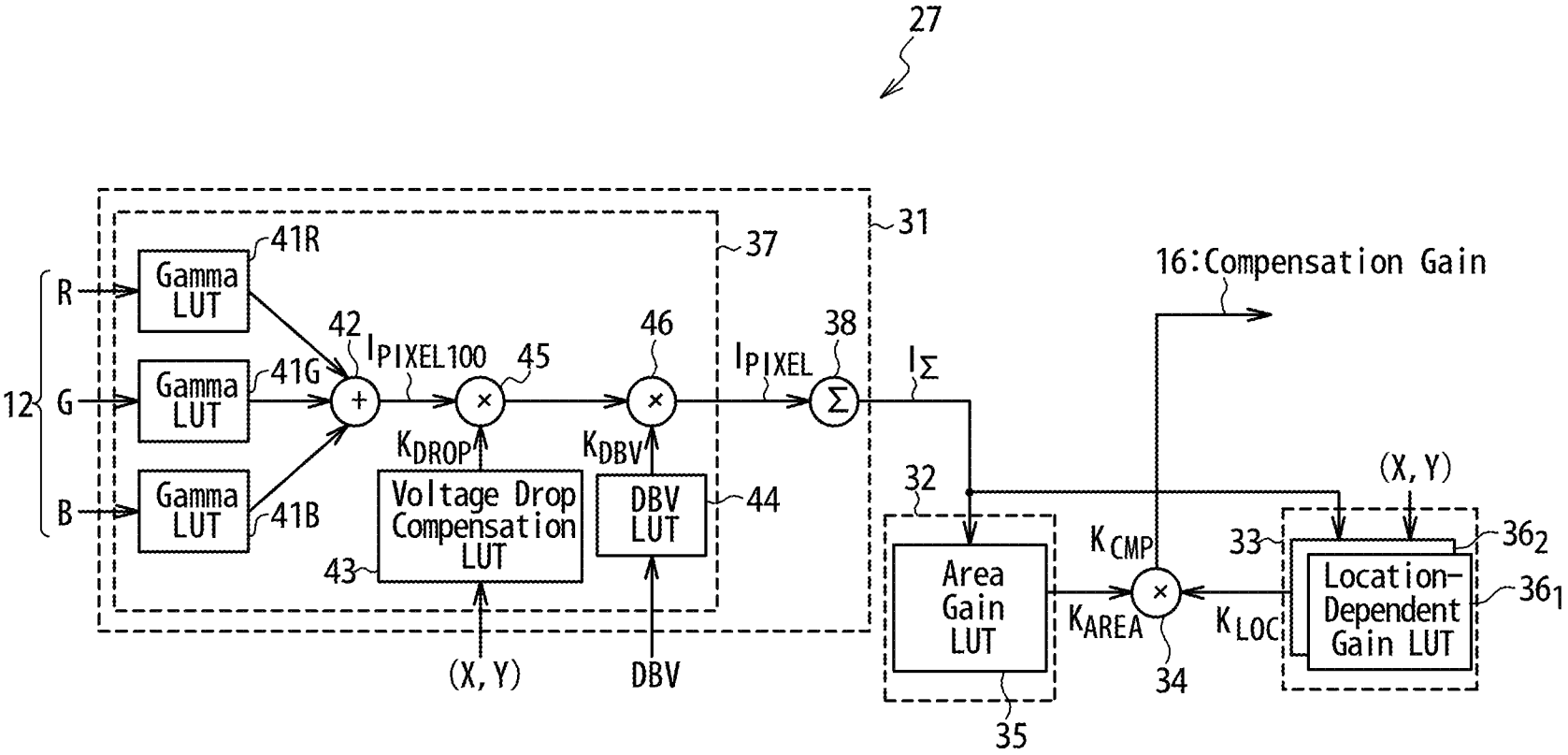
FIG. 6 illustrates one example configuration of compensation circuitry, according to one or more embodiments.

In one or more embodiments, as illustrated in FIG. 6, the compensation circuitry 27 comprises total current calculation circuitry 31, area gain generator circuitry 32, position-dependent gain generator circuitry 33, and compensation gain calculation circuitry 34.

In one or more embodiments, the total current calculation circuitry 31 is configured to calculate a simulated value b of the total current consumed in the pixels 8 of the display panel 10. In one or more embodiments, the simulated value of the total current consumed in the pixels 8 of the display panel 10 may be calculated as being a value representing the total sum of the luminance levels of the pixels 8 of the display panel 10. For example, the current flowing through the pixel circuits 6 included in each pixel 8 and flowing through the respective OLED elements included may correspond to the luminance level of each pixel 8.

In one or embodiments, the area gain generator circuitry 32 is configured to generate an area gain $K_{AREA}$ based on the simulated value $I_\Sigma$ of the total current. In one or more embodiments, the area gain generator circuitry 32 may comprise correspondence information indicative of a correspondence relation between the simulated value $I_\Sigma$ of the total current and the area gain $K_{AREA}$ and generate the area gain $K_{AREA}$ based on the correspondence information. In one or more embodiments, the voltage drop across the power source lines 7 depends on the total current consumed in the pixels 8 of the display panel 10 and the area gain $K_{AREA}$ is used to compensate a component of the voltage drop depending on the total current.

In one or more embodiments, the area gain generator circuitry 32 comprises an area gain lookup table (LUT) 35. In such embodiments, the correspondence information is stored in the form of values of the area gain LUT 35. In one or more embodiments, the area gain generator circuitry 32 is configured to generate the area gain $K_{AREA}$ through a table lookup on the area gain LUT 35 with reference to the simulated value $I_\Sigma$.

In alternative embodiments, the area gain generator circuitry 32 may be configured to calculate the area gain $K_{AREA}$ by performing digital processing on the simulated value $I_\Sigma$ of the total current. In such embodiments, the correspondence information may be stored in the area gain generator circuitry 32 in the form of information which determines one or more equations used in the digital processing.

In one or more embodiments, the position-dependent gain generator circuitry 33 is configured to generate a position-dependent gain $K_{LOC}$ based on the position (X,Y) of the pixel 8 of interest. In one or more embodiments, the position-dependent gain generator circuitry 33 comprises correspondence information indicative of a correspondence relation between the position-dependent gain $K_{LOC}$ and the position (X,Y) of the pixel 8 of interest and generates the position-dependent gain $K_{LOC}$ based on the correspondence information.

In one or more embodiments, the correspondence relation between the position-dependent gain $K_{LOC}$ and the position (X,Y) of the pixel 8 of interest depends on the simulated value $I_\Sigma$ of the total current. In one or more embodiments, this offers appropriate compensation of the voltage drop and effectively suppresses mura in the displayed image, even when the voltage drop across the power source lines 7 causes variations in the dark-bright pattern depending on the current level of the total current.

In one or more embodiments, the position-dependent gain generator circuitry 33 comprises first correspondence information indicative of the correspondence relation between the position-dependent gain $K_{LOC}$ and the position (X,Y) of the pixel 8 of interest for a first current value of the total current and second correspondence information indicative of the correspondence relation between the location-dependent gain $K_{LOC}$ and the position (X,Y) of the pixel 8 of interest for a second current value of the total current and is configured to generate the position-dependent gain $K_{LOC}$ based on the first correspondence information and the second correspondence information. In one or more embodiments, the position-dependent gain generator circuitry 33 is configured to calculate the position-dependent gain $K_{LOC}$ through a procedure comprising:

(1) generating a position-dependent gain for the first current value based on the first correspondence information and the position (X,Y) of the pixel 8 of interest;

(2) generating a position-dependent gain for the second current value based on the second correspondence information and the position (X,Y) of the pixel 8 of interest; and (3) calculating the position-dependent gain $K_{LOC}$ to be finally obtained through interpolation between the position-dependent gain for the first current value and the position-dependent gain for the second current value, based on the simulated value $I_{\Sigma}$ of the total current.

In one or more embodiments, the first current value is the allowed maximum current value of the simulated value $I_{\Sigma}$ of the total current, and the second current value is the allowed minimum current value of the simulated value $I_{\Sigma}$ of the total current.

In one or more embodiments, the position-dependent gain generator circuitry 33 comprises position-dependent gain LUTs $\mathbf{36}_1$ and $\mathbf{36}_2$. In one or more embodiments, the position-dependent gain LUT$\mathbf{36}_1$ describes position-dependent gains $K_{LOC}$ for respective positions (X,Y) of the pixel 8 of interest for the first current value, and the position-dependent gain LUT$\mathbf{36}_2$ describes position-dependent gains $K_{LOC}$ for respective positions (X,Y) of the pixel 8 of interest for the second current value. In such embodiments, the first correspondence information described above is stored in the form of the values of the position-dependent gain LUT$\mathbf{36}_1$, and the second correspondence information described above is stored in the form of the values of the position-dependent gain LUT$\mathbf{36}_2$.

In one or more embodiments, the position-dependent gain generator circuitry 33 is configured to calculate the position-dependent gain $K_{LOC}$ through a procedure comprising:

(1) generating a position-dependent gain for the first current value through a table lookup on the position-dependent gain LUT $\mathbf{36}_1$ with reference to the position (X,Y) of the pixel 8 of interest;

(2) generating a position-dependent gain for the second current value through a table lookup on the position-dependent gain LUT $\mathbf{36}_2$ with reference to the position (X,Y) of the pixel 8 of interest; and (3) calculating the position-dependent gain $K_{LOC}$ to be finally obtained through interpolation between the position-dependent gain for the first current value and the position-dependent gain for the second current value, based on the simulated value $I_{\Sigma}$ of the total current.

In one or more embodiments, the compensation gain calculation circuitry 34 is configured to calculate a compensation gain 16 based on the area gain $K_{AREA}$ and the position-dependent gain $K_{LOC}$. In one or more embodiments, the compensation gain calculation circuitry 34 is configured to calculate the compensation gain 16 as being the product $K_{CMP}$ of the area gain $K_{AREA}$ and the position-dependent gain $K_{LOC}$.

In one or more embodiments, the compensation gain 16 thus generated is transferred to the output voltage data generation circuitry 28 and used for generation of the compensated voltage data 14. In one or more embodiments, when a compensated voltage data 14 corresponding to a certain pixel 8 is generated, the compensated voltage data 14 corresponding to the pixel 8 is calculated by multiplying the voltage data 15 calculated for the pixel 8 by the compensation gain 16 calculated for the pixel 8.

In one or more embodiments, the position-dependent gain generator circuitry 33 comprises three or more LUTs describing position-dependent gains $K_{LOC}$ for the respective positions (X,Y) of the pixel 8 of interest for different current values. In such embodiments, the position-dependent gain generator circuitry 33 is configured to calculate the position-dependent gain $K_{LOC}$ to be finally obtained through interpolation among the position-dependent gains obtained through table lookups on the three or more LUTs.

In one or more embodiments, the compensation circuitry 27 described above also achieves compensation of voltage drop in a display panel 10 configured to receive the power source voltage ELVDD from a single power source when LUTs of the same contents are used as the position-dependent gain LUTs $\mathbf{36}_1$ and $\mathbf{36}_2$.

In one or more embodiments, the total current calculation circuitry 31 comprises pixel current calculation circuitry 37 and accumulator circuitry 38.

In one or more embodiments, the pixel current calculation circuitry 37 is configured to calculate a simulated value $I_{PIXEL}$ of the current consumed in each pixel 8 based on the image data 12 associated with the pixel 8 of interest, the position (X,Y) of the pixel 8, and a display brightness value DBV. In one or more embodiments, the display brightness value DBV specifies the brightness level of the image displayed on the display panel 10. In one or more embodiments, the display brightness value DBV may be determined by the host 40 based on a user operation or internally determined in the display driver 20 based on an external display brightness value specified by the host 40. In one or more embodiments, when adjustment of the brightness level of the displayed image is requested by a user observing the display panel 10, the display brightness value DBV may be adjusted based on a user operation on an input device. In one or more embodiments, since the luminance level of each pixel 8 corresponds to the total current flowing through the pixel circuits 6 such as the total current flowing through the OLED elements of the pixel 8, the simulated value $I_{PIXEL}$ of the current consumed in each pixel 8 may be calculated as being the luminance level of each pixel 8.

In one or more embodiments, the pixel current calculation circuitry 37 comprises: gamma LUTs 41R, 41G, 41B, an adder 42, a voltage drop compensation LUT 43, a display brightness value LUT 44, and multipliers 45, 46.

In one or more embodiments, the image data 12 associated with each pixel 8 comprises a grayscale value R of the R subpixel 6R, a grayscale value G of the G subpixel 6G, and a grayscale value B of the B subpixel 6B, and the gamma LUTs 41R, 41G, 41B and the adder 42 is used for calculating the current $I_{PIXEL100}$ flowing through each pixel 8 based on the grayscale values R, G, and B for the case where the display brightness value DBV is a specific value, for example, the allowed maximum value.

In one or more embodiments, the gamma LUT 41R describes a correspondence relation between the grayscale value R and the current flowing through an R subpixel 6R for the case where the display brightness value DBV is a specific value, such as the allowed maximum value. In one or more embodiments, the current flowing through an R subpixel 6R is calculated through a table lookup on the gamma LUT 41R with reference to the grayscale value R. In one or more embodiments, the gamma LUT 41G describes a correspondence relation between the grayscale value G and the current flowing through a G subpixel 6G for the case where the display brightness value DBV is the specific value. In one or more embodiments, the current flowing through a G subpixel 6G is calculated through a table lookup on the gamma LUT 41G with reference to the grayscale value G. In one or more embodiments, the gamma LUT 41B describes a correspondence relation between the grayscale value B and the current flowing through a B subpixel 6B for the case where the display brightness value DBV is the specific value. In one or more embodiments, the current flowing through a B subpixel 6B is calculated through a table lookup on the gamma LUT 41B with reference to the grayscale value B.

In one or more embodiments, the adder 42 calculates the current $I_{PIXEL100}$ flowing through the pixel 8 of interest for the case where the display brightness value DBV is the specific value, by adding up the currents flowing through the R, G, and B subpixels 6R, 6G, and 6B calculated by using the gamma LUTs 41R, 41G, and 41B.

In one or more embodiments, the voltage drop compensation LUT43 describes the correspondence relation between the position (X,Y) of the pixel 8 and a voltage drop compensation gain $K_{DROP}$. In one or more embodiments, the voltage drop compensation gain $K_{DROP}$ is obtained through a table lookup on the voltage drop compensation LUT 43 with reference to the position (X,Y) of the pixel 8. In one or more embodiments, the voltage drop compensation gain $K_{DROP}$ is used to compensate an influence of the voltage drop across the power source lines 7 on the current flowing through the pixel 8.

In one or more embodiments, the display brightness value LUT 44 describes a correspondence relation between the display brightness value DBV and a DBV-dependent gain $K_{DBV}$. In one or more embodiments, a DBV-dependent gain $K_{DBV}$ is obtained through a table lookup on the display brightness value LUT 44 with reference to the display brightness value DBV. In one or more embodiments, the DBV-dependent gain $K_{DBV}$ represents the dependency of the current flowing through the pixel 8 on the display brightness value DBV.

In one or more embodiments, the multipliers 45 and 46 are configured to calculate the simulated value $I_{PIXEL}$ of the current flowing through each pixel 8 by multiplying the current $I_{PIXEL100}$ calculated for the pixel 8 of interest by the voltage drop compensation gain $K_{DROP}$ and the DBV-dependent gain $K_{DBV}$.

In one or more embodiments, the accumulator circuitry 38 is configured to calculate the simulated value $I_{\Sigma}$ of the total current by accumulating the simulated values $I_{PIXEL}$ for all the pixels 8 of the display panel 10.

Figure 7:
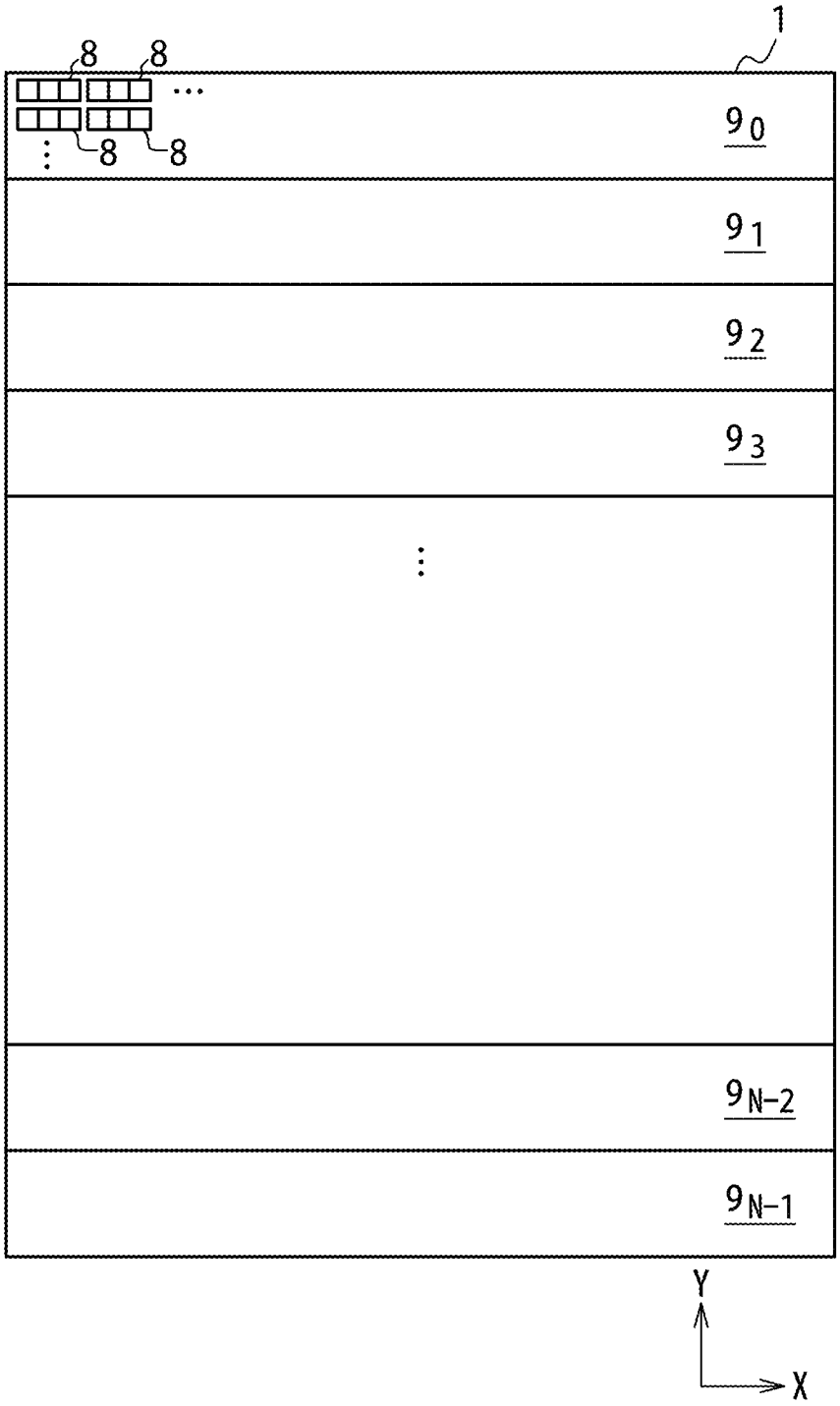
FIG. 7 illustrates one example configuration of a pixel array, according to one or more embodiments.

In one or more embodiments, as illustrated in FIG. 7, the pixel array 1 is segmented into N segments $\mathbf{9}_0$ to $\mathbf{9}_{N-1}$, and the accumulator circuitry 38 is configured to store therein sums s[0] to s[N−1] of the simulated values $I_{PIXEL}$ of the currents flowing through the pixels 8 positioned in the segments $\mathbf{9}_0$ to $\mathbf{9}_{N-1}$, respectively, where N is an integer of two or more and the sum s[i] is the sum of the simulated values $I_{PIXEL}$ of the currents flowing through the pixels 8 positioned in the segment $\mathbf{9}_i$. In FIG. 7, the X axis is defined in the direction in which the gate lines 4 are extended, and the direction of the X axis may be referred to as "horizontal direction." The Y axis is defined in the direction in which the source lines 5 are extended, and the direction of the Y axis may be referred to as "vertical direction." In one or more embodiments, the segments $\mathbf{9}_0$ to $\mathbf{9}_{N-1}$ are arrayed in the vertical direction, that is, the direction in which the source lines 5 are extended. In one or more embodiments, each of the segments $\mathbf{9}_0$ to $\mathbf{9}_{N-1}$ comprises a plurality of horizontal lines, where a horizontal line is one line of pixels 8 arrayed in the horizontal direction, that is, a group of pixels 8 connected to the same gate line 4.

Figure 8:
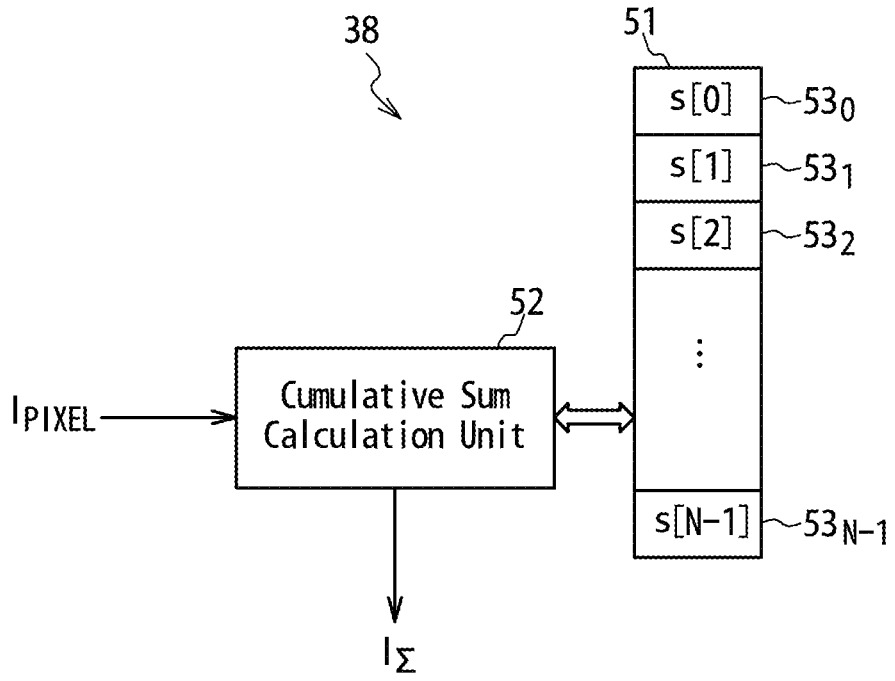
FIG. 8 illustrates one example configuration of accumulation circuitry, according to one or more embodiments.

In one or more embodiments, as illustrated in FIG. 8, the accumulator circuitry 38 comprises a memory 51 and a cumulative sum calculation unit 52. In one or more embodiments, the memory 51 comprises memory regions $\mathbf{53}_0$ to $\mathbf{53}_{N-1}$ associated with the segments $\mathbf{9}_0$ to $\mathbf{9}_{N-1}$, respectively. In one or more embodiments, the memory regions $\mathbf{53}_0$ to $\mathbf{53}_{N-1}$ are used to store the sums s[0] to s[N−1] of the simulated values $I_{PIXEL}$ calculated for the segments $\mathbf{9}_0$ to $\mathbf{9}_{N-1}$, respectively. In one or more embodiments, the cumulative sum calculation unit 52 is configured to sequentially receive the simulated values $I_{PIXEL}$ of the currents consumed in the respective pixels 8 from the pixel current calculation circuitry 37 and calculating the sums s[0] to s[N−1] of the simulated values $I_{PIXEL}$ by accumulating the simulated values $I_{PIXEL}$ for the respective segments $\mathbf{9}_0$ to $\mathbf{9}_{N-1}$. The cumulative sum calculation unit 52 is further configured to calculate the simulated value $I_{\Sigma}$ of the total current consumed in the pixels 8 of the display panel 10 based on the sums s[0] to s[N−1] stored in the memory regions $\mathbf{53}_0$ to $\mathbf{53}_{N-1}$.

In one or more embodiments, the accumulator circuitry 38 is configured to, when drive voltages are written into pixels 8 positioned in the segment $\mathbf{9}_i$ in a certain frame period (the current frame period), calculate the simulation value $I_{\Sigma}$ of the total current used for calculating the compensated voltage data 14 specifying the drive voltages as being the sum of the sums s[0] to s[N−1] of the simulated values $I_{PIXEL}$ stored in the memory regions $\mathbf{53}_0$ to $\mathbf{53}_{N-1}$. In one or more embodiments, with respect to the segment $\mathbf{9}_i$ for which drive voltages are being currently written into the pixels 8 and the segments $\mathbf{9}_{i+1}$ to $\mathbf{9}_{N-1}$ for which drive voltages have not yet been written in the current frame period, the sums s[i] to s[N−1] calculated based on the image data 12 corresponding to the image displayed in the previous frame period is used for the calculation of the simulation value $I_{\Sigma}$ of the total current. In one or more embodiments, with respect to the segments $\mathbf{9}_0$ to $\mathbf{9}_{i-1}$ for which drive voltages have been already written, the sums s[0] to s[i−1] calculated based on the image data 12 corresponding to the image displayed in the current frame period is used for the calculation of the simulation value $I_{\Sigma}$ of the total current.

In the following, the sum s[0] to s[N−1] calculated from the image data 12 corresponding to the image displayed in the previous frame period may be referred to as sums $s_o[0]$ to $s_o[N-1]$, and the sum s[0] to s[N−1] calculated from the image data 12 corresponding to the image displayed in the current frame period may be referred to as sums $s_n[0]$ to $s_n[N-1]$. Additionally, the thus-calculated simulated value $I_{\Sigma}$ of the total current may be referred to as simulated value $I_{\Sigma}$ of the total current for the segment $\mathbf{9}_i$.

Figure 9A:
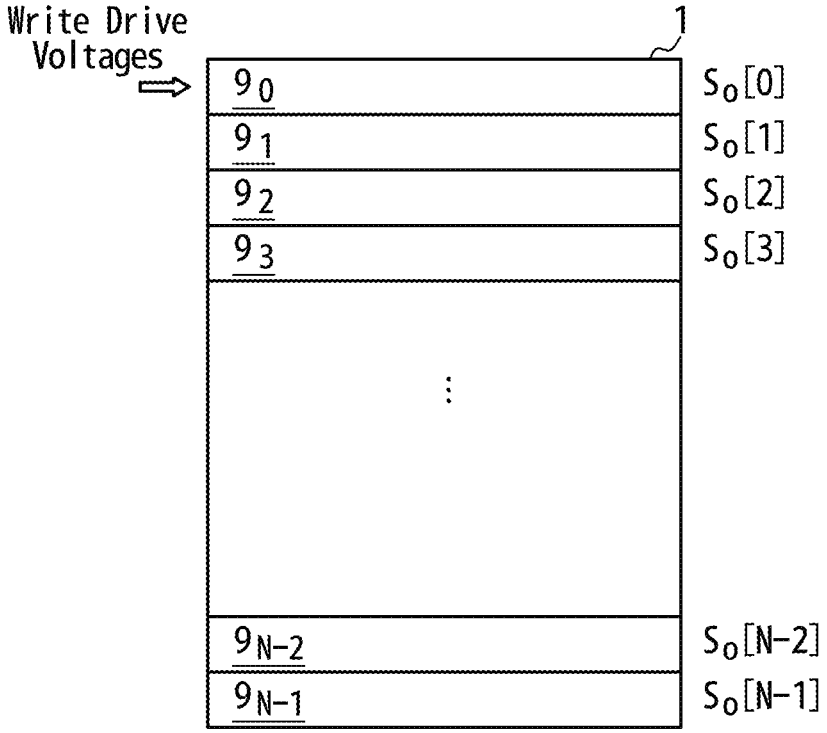
FIGS. 9A, 9B and 9C illustrate one example operation of accumulation circuitry, according to one or more embodiments.

When i=0, that is, when drive voltages are written into the pixels 8 in the topmost segment $\mathbf{9}_0$ in the current frame period as illustrated in FIG. 9A, the simulated value $I_{\Sigma}$ of the total current for the segment $9_0$ is calculated in accordance with the following equation (1) in one or more embodiments:

$$I_\Sigma = \sum_{k=0}^{N-1} s_o[k]. \tag{1}$$

Figure 9B:
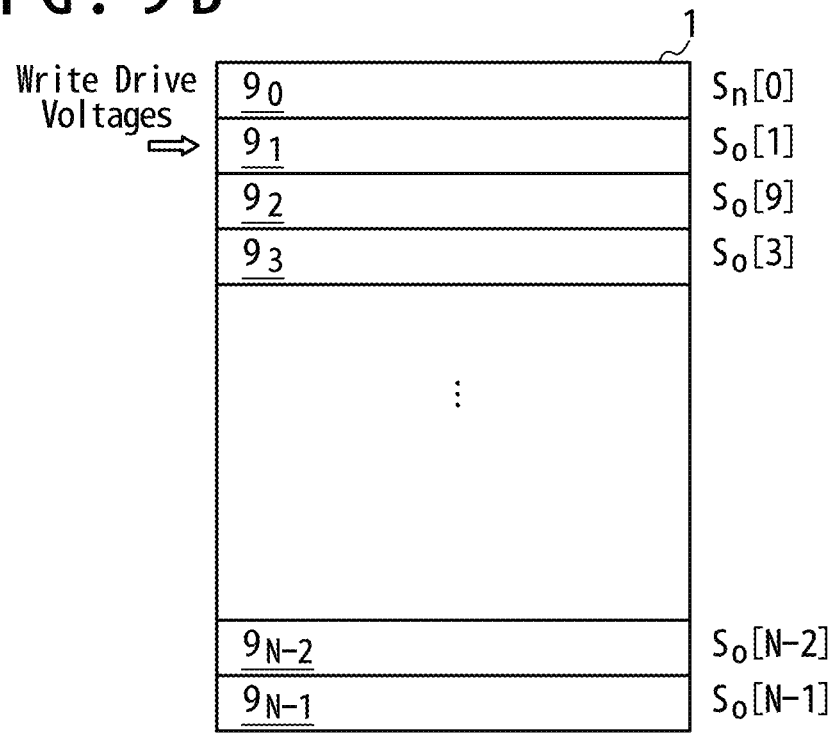
Figure 9C:
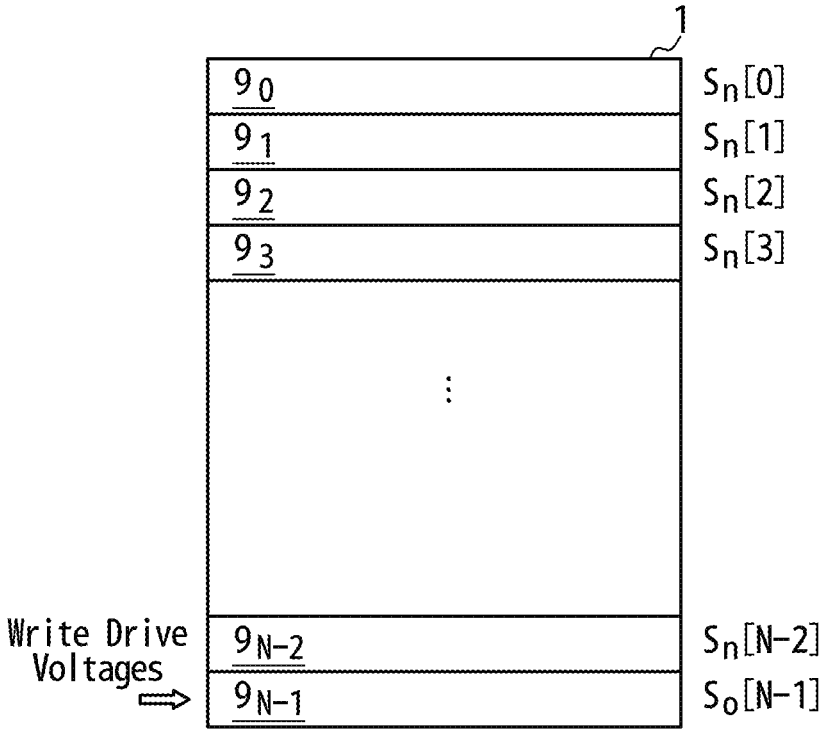

When i≠0, that is, when drive voltages are written into the pixels 8 in the segment $9_i$ other than the segment $9_0$ in the current frame period as illustrated in FIGS. 9B and 9C, the simulated value $I_\Sigma$ of the total current for the segment $9_i$ is calculated in accordance with the following equation (2) in one or more embodiments:

$$I_\Sigma = \sum_{k=0}^{i-1} s_n[k] + \sum_{k=i}^{N-1} s_o[k]. \tag{2}$$

For example, when i=1, that is, when drive voltages are written into the pixels 8 in the second topmost segment $9_1$, the simulated value $I_\Sigma$ of the total current for the segment $9_1$ is calculated in accordance with the following equation (3), in one or more embodiments:

$$I_\Sigma = \sum_{k=0}^{0} s_n[k] + \sum_{k=1}^{N-1} s_o[k]. \tag{3}$$

When drive voltages are written into the pixels 8 in the bottommost segment $9_{N-1}$ as illustrated in FIG. 9C, the simulated value $I_\Sigma$ of the total current for the segment $9_{N-1}$ is calculated in accordance with the following equation (4) in one or more embodiments:

$$I_\Sigma = \sum_{k=0}^{N-2} s_n[k] + \sum_{k=N-1}^{N-1} s_o[k]. \tag{4}$$

In one or more embodiments, the accumulator circuitry 38 is further configured to calculate the sums s[0] to s[N−1] of the simulated values $I_{PIXEL}$ of the currents flowing through the pixels 8 in the respective segments $9_0$ to $9_{N-1}$. In one or more embodiments, the accumulator circuitry 38 is configured to, when having calculated the sum s[i] of the simulated values $I_{PIXEL}$ of the currents flowing through the pixels 8 in a certain segment $9_i$, write the calculated sum s[i] into the associated memory region $53_i$ after calculating the simulated value $I_\Sigma$ of the total current for the segment $9_i$. This is because the sum $s_o$[i] calculated based on the image data 12 corresponding to the image displayed in the previous frame period is used to calculate the simulated value $I_\Sigma$ of the total current for the segment $9_i$, for which drive voltages are being currently written into the pixels 8, as described above.

In one or more embodiments, this operation makes it possible to calculate the simulated value $I_\Sigma$ of the total current while reducing the capacity of a memory disposed in the accumulator circuitry 38. In one or more embodiments, the simulated value $I_\Sigma$ of the total current thus-calculated is transmitted to the area gain generator circuitry 32 and used to generate the area gain $K_{AREA}$. In one or more embodiments, the area gain generator circuitry 32 is configured to generate the area gain $K_{AREA}$ through a table lookup on the area gain LUT 35 with reference to the simulated value $I_\Sigma$ of the total current.

When the simulated value $I_\Sigma$ of the total current is calculated based on the sums s[0] to s[N−1] of the simulated values $I_{PIXEL}$ calculated for the segments $9_0$ to $9_{N-1}$ as described above, in one or more embodiments, the area gain generator circuitry 32 is configured to, in generating the area gain $K_{AREA}$, perform interpolation based on the position of the pixel 8 of interest in the Y axis direction (the direction in which the source lines 5.) In one or more embodiments, this effectively suppresses changes in the area gain $K_{AREA}$ at the boundary of adjacent segments 9. In one or more embodiments, the area gain generator circuitry 32 is configured to calculate the area gain $K_{AREA}$ to be finally used to calculate the compensated voltage data 14 of the pixel 8 of interest through interpolation between an area gain $K_{AREA_C}$ and an area gain $K_{AREA_P}$ based on the position of the pixel 8 of interest in the Y axis direction, where the area gain $K_{AREA_C}$ is generated based on the simulated value $I_\Sigma$ of the total current calculated for the segment $9_i$ and the area gain $K_{AREA_P}$ is generated based on the simulated value $I_\Sigma$ of the total current which has been calculated for the segment $9_{i-1}$ (or the segment $9_{N-1}$ for i=0) just previously.

In one or more embodiments, the area gain generator circuitry 32 is configured to calculate the area gain $K_{AREA}$ to be finally used for the pixels 8 positioned in the $j^{th}$ topmost horizontal line of a certain segment $9_i$ in accordance with the following expression (5):

$$K_{AREA}=\{K_{AREA_P}\times(M-j)+K_{AREA_C}\times 1\}/M, \tag{5}$$

where M is the number of horizontal lines included in each of the segments $9_0$ to $9_{N-1}$.

Figure 10:
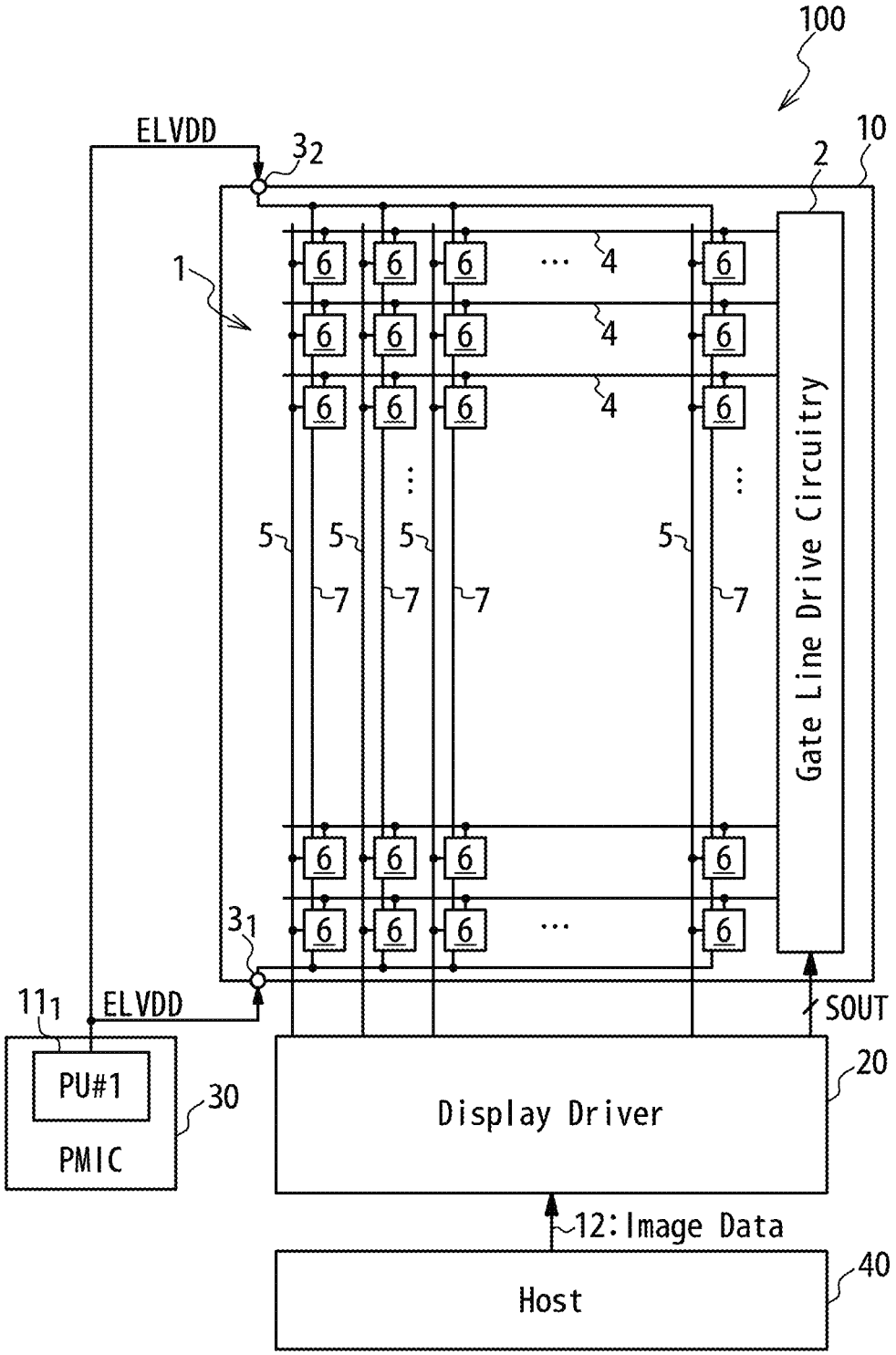
FIG. 10 illustrates one example configuration of a display device, according to one or more embodiments.

In one or more embodiments, as illustrated in FIG. 10, the power source $11_1$ of the PMIC 30 supplies the power source voltage ELVDD to the two power source terminals $3_1$ and $3_2$. The voltage drop compensation described above is also effective for this configuration. The configuration illustrated in FIG. 10 may exhibit changes in the dark-bright pattern depending on the brightness level of the image displayed on the display panel 10, due to a difference in the interconnection resistance from the output of the PMIC 30 to the power source terminals $3_1$ and $3_2$ and the like, similarly to the configuration illustrated in FIG. 1 in which the two power sources $11_1$ and $11_2$ respectively supply the power source voltage ELVDD to the power source terminals $3_1$ and $3_2$. In one or more embodiments, use of the display driver 20 illustrated in FIG. 3 for the display device 100 configured as illustrated in FIG. 10 effectively suppresses mura in the displayed image caused by voltage drop across the power source lines 7. A similar goes for a case where the display panel 10 comprises three or more power source terminals, and the power source $11_1$ of the PMIC 30 supplies the power source voltage ELVDD to the three or more power source terminals.

Although various embodiments have been specifically described in this disclosure, a person skilled in the art would appreciate that the technologies disclosed herein may be implemented with various modifications. For example, a person skilled in the art would appreciate that the above-described embodiments are applicable to various other display panels configured to supply the power source voltage to respective pixel circuits, as well as OLED display panels.

What is claimed is:

1. A display driver, comprising:

image processing circuitry configured to generate a first voltage data based on an image data corresponding to an image to be displayed on a display panel;

compensation circuitry configured to generate correction values for a plurality of pixels of the display panel based on a total current consumed by the plurality of pixels and positions of the plurality of pixels;

voltage data generator circuitry configured to generate a second voltage data by correcting the first voltage data based on the correction values; and drive circuitry configured to write drive voltages into the plurality of pixels based on the second voltage data.

2. The display driver according to claim 1, wherein the correction values are generated to compensate for voltage drop across power source lines in the display panel.

3. The display driver according to claim 1, wherein the correction values comprise compensation gains.

4. The display driver according to claim 3, wherein the compensation circuitry is configured to:

generate an area gain based on the total current;

generate, for the plurality of pixels, position-dependent gains based on the positions of the plurality of pixels in the display panel; and calculate the compensation gains based on the area gain and the position-dependent gains.

5. The display driver according to claim 4, wherein the voltage data generator circuitry is further configured to calculate voltage values described in the second voltage data as being products of the compensation gains and voltage values described in the first voltage data.

6. The display driver according to claim 4, wherein a correspondence relation between the positions of the plurality of pixels and the position-dependent gains depends on the total current.

7. The display driver according to claim 4, wherein the compensation circuitry is configured to calculate the position-dependent gains based on first correspondence information and second correspondence information, wherein the first correspondence information is indicative of a correspondence relation between the positions of the plurality of pixels and the position-dependent gains for a first current value of the total current, and wherein the second correspondence information is indicative of a correspondence relation between the positions of the plurality of pixels and the position-dependent gains for a second current value of the total current.

8. The display driver according to claim 4, wherein the compensation circuitry comprises:

a first lookup table (LUT) describing a correspondence relation between the positions of the plurality of pixels and the position-dependent gains for a first current value of the total current; and a second LUT describing a correspondence relation between the positions of the plurality of pixels and the position-dependent gains for a second current value of the total current, and wherein the compensation circuitry is configured to calculate the position-dependent gains based on the first LUT and the second LUT.

9. The display driver according to claim 8, wherein the compensation circuitry is further configured to:

calculate a simulated value of the total current; and calculate the position-dependent gains through interpolation between first position-dependent gains associated with the positions of the plurality of pixels in the first LUT and second position-dependent gains associated with the positions of the plurality of pixels in the second LUT, and wherein the interpolation is based on the simulated value of the total current.

10. The display driver according to claim 4, wherein the compensation circuitry is further configured to:

calculate a simulated value of the total current; and generate the area gain based on the simulated value of the total current.

11. The display driver according to claim 10, wherein the compensation circuitry is further configured to:

for a plurality of segments of the display panel, calculate sums of simulated values of currents flowing through a subset of pixels of the plurality of pixels disposed in the plurality of segments; and calculate the simulated value of the total current based on the sums calculated for the plurality of segments.

12. The display driver according to claim 11, wherein the compensation circuitry is configured to, when drive voltages are written into one or more of the plurality of pixels of a first segment of the plurality of segments in a first frame period, calculate the simulated value of the total current based on:

one or more sums calculated based on image data corresponding to an image displayed in a previous frame period for the first segment and one or more segments of the plurality of segments for which drive voltages have not yet been written in the first frame period; and one or more sums calculated based on the image data corresponding to an image displayed in the first frame period for one or more segments of the plurality of segments for which drive voltages have been already written in the first frame period.

13. The display driver according to claim 12, wherein the compensation circuitry is further configured to, when the drive voltages are written into the pixels in the first segment, generate the area gain used for generating the compensation gains through interpolation based on the positions of the pixels in the first segment between the area gain obtained based on the simulated value of the total current calculated for the first segment and the area gain obtained based on the simulated value of the total current calculated for a segment different from the first segment.

14. A display device, comprising:

a display panel comprising a plurality of power source terminals and a plurality of pixels configured to receive a power source voltage from the plurality of power source terminals;

image processing circuitry configured to generate a first voltage data based on an image data corresponding to an image to be displayed on the display panel;

compensation circuitry configured to generate correction values for the plurality of pixels based on a total current consumed in the plurality of pixels and positions of the plurality of pixels;

voltage data generator circuitry configured to generate a second voltage data by correcting the first voltage data based on the correction values; and drive circuitry configured to write drive voltages into the plurality of pixels based on the second voltage data.

15. The display device according to claim 14, wherein the correction values comprise compensation gains, wherein the compensation circuitry is configured to:

generate an area gain based on the total current;

generate, for the plurality of pixels, position-dependent gains based on positions of the plurality of pixels in the display panel; and calculate the compensation gains based on the area gain and the position-dependent gains.

16. The display device according to claim 15, wherein a correspondence relation between the positions of the plurality of pixels and the position-dependent gains depends on the total current.

17. The display device according to claim 15, wherein the compensation circuitry comprises:

a first lookup table (LUT) describing a correspondence relation between the positions of the plurality of pixels and the position-dependent gains for a first current value of the total current; and a second LUT describing a correspondence relation between the positions of the plurality of pixels and the position-dependent gains for a second current value of the total current, and wherein the compensation circuitry is configured to calculate the position-dependent gains based on the first LUT and the second LUT.

18. A method for driving a display panel, the method comprising:

generating a first voltage data based on an image data corresponding to an image to be displayed on the display panel comprising a plurality of power source terminals and a plurality of pixels configured to receive a power source voltage from the plurality of power source terminals;

generating correction values for the plurality of pixels based on a total current consumed in the plurality of pixels and positions of the plurality of pixels;

generating a second voltage data by correcting the first voltage data based on the correction values; and writing drive voltages into the plurality pixels based on the second voltage data.

19. The method according to claim 18, wherein the correction values comprise compensation gains, and wherein generating the second voltage data comprises:

generating an area gain based on the total current;

generating, for the plurality of pixels, position-dependent gains based on positions of the plurality of pixels in the display panel;

calculating the compensation gains based on the area gain and the position-dependent gains; and generating the second voltage data based on the first voltage data and the compensation gains.

20. The method according to claim 19, wherein a correspondence relation between the positions of the plurality of pixels and the position-dependent gains depends on the total current.

* * * * *